US005259074A

United States Patent [19]

Battle

[11] Patent Number: 5,259,074

[45] Date of Patent: Nov. 9, 1993

[54] FLUSH VALVE CONTROL APPARATUS

[76] Inventor: John R. Battle, 11306 W. Pool Ct., Crystal River, Citrus County, Fla. 32629

[21] Appl. No.: 870,993

[22] Filed: Apr. 20, 1992

[51] Int. Cl.[5] ..... E03D 1/14

[52] U.S. Cl. ..... 4/325; 4/415

[58] Field of Search ..... 4/324, 325, 403, 404, 4/415

[56] References Cited

U.S. PATENT DOCUMENTS 4,175,296 11/1979 Goldman ..... 4/325

4,945,580 8/1990 Schmitt et al. ..... 4/325

*Primary Examiner*—Charles E. Phillips

*Attorney, Agent, or Firm*—Arthur W. Fisher, III

[57] ABSTRACT

A flush valve control apparatus selectively operable in a partial flush mode and full flush mode for use with a water closet including a flush drain aperture and a buoyant flapper valve having an air chamber formed therein, the flush valve control apparatus comprises a first and second valve control, the first valve control operatively coupled between the second valve control and the atmosphere includes a first valve actuator movable between a first or closed position and a second or open position and a first valve housing to selectively control the flow of air from the second valve control through the first valve control to the atmosphere, and the second valve control operatively coupled between the first valve control and the buoyant flapper valve includes a second valve actuator movable between a first or open position and a second or closed position and a second valve housing to selectively control the flow of air from the air chamber through the first and second valve controls to the atmosphere to selectively control the action of the buoyant flapper valve to operate in the partial flush mode or the full flush mode.

19 Claims, 8 Drawing Sheets

FLUSH VALVE CONTROL APPARATUS

BACKGROUND OF THE INVENTION

1. Field of the Invention

A flush valve control apparatus to selectively control the volume of water dispersed from a water closet flush tank.

2. Description of the Prior Art

Sanitary water closets have for years been constructed with a water storage tank secured to the back side of the toilet bowl. The tank is connected to the domestic water supply. An automatic fill valve mechanism in the tank includes a float-operated valve for filling of the storage tank to a selected level. Normally, tanks are presently constructed to hold between six and eight gallons of water. The bottom of the storage tank is connected to the toilet bowl with a normally closed ball valve structure. A flush handle on the storage tank is coupled through a linkage mechanism to the ball valve. Opening of the valve discharges the stored water from the tank for flushing of the toilet bowl. For many years, a simple float ball valve on a suitable guide stem was used. More recently, a flapper-type ball valve is also used, wherein the ball valve is secured by a rubber hinge directly to the overflow tube. Actuating of the flush handle results in the lifting and pivoting of the ball valve about the rubber hinge.

Conventional flush tanks now in general use discharge the entire amount of water stored in the tank upon each flushing operation even though only a fraction of that quantity of water may be required for flushing the waste material. This results in unnecessary water consumption increased water costs and presents special problems where the water is flushed into a cesspool or septic tank. In many places there is a critical shortage of water. This waste contributes significantly to the shortage. In addition, many municipal waste disposal systems are already overburdened with the increasing quantities of sewerage water that flows through the sewer systems and treatment plants.

It has long been recognized that substantial water saving can be achieved by the provision of a variable flushing control for varying the quantity of water utilized in flushing in accordance with the quantity and character of the waste material to be flushed. Toward this end, various water saving flush tanks and variable flushing control devices have been proposed in the past.

One type of flush tank includes a partitioned tank, separate water discharging devices and duplication of plumbing for discharging water from one or both parts of the partitioned tank. In another type, the discharge of water from the tank is controlled by two columns in end-to-end relationship with provision for lifting the upper column for a partial f-Lush and both columns for a full flush.

Other types of variable flushing control devices have been proposed which rely on the venting of air from the conventional hollow ball valve to effect a partial flush. For example, in the variable flushing control device described in U.S. Pat. No. 2,741,776, a tube supporting a ball-type discharge valve has a positively actuated valve at the upper end thereof to partially exhaust air from an air chamber within the bail valve when the ball valve is lifted to bring the valve into contact with an actuating bar. The partial evacuation of the air from the ball valve permits gradual reseating of the ball valve upon release thereof. A number of other systems using the venting principle have been devised, but in general, such prior art employ complicated and expensive structures and are not adapted for use in conventional flush tanks.

U.S. Pat. No. 4,945,580 teaches a vented buoyant outlet closure allowing the flapper to prematurely terminate the flushing cycle. The venting is controlled by turning the externally mounted operating handle in one direction. When the operating handle is turned in the opposite direction, essentially all the water is discharged from the tank effecting a full flush cycle.

U.S. Pat. No. 3,546,715 shows an adjustable toilet tank flush valve in which the discharge of water from the tank is reduced in accordance with the setting of an adjustable vent valve. A slidable control member is incorporated with the handle to override the reduced discharge and permit a full tank discharge.

U.S. Pat. No. 4,000,526 teaches a flush valve assembly for a partial flushing operation including a floating flapper valve device for sealing the drain valve seat. The floating flapper valve device includes an air trapping float chamber and an inlet mounted in fluid communication with the chamber for trapping air in the chamber to delay the closing of the flapper device. A vent mounted in fluid communication with the chamber enables at least some of the trapped air to be released from the chamber enabling the flapper device to close prematurely thereby causing a partial flush operation to occur. A trip lever assembly controls the operation of the floating flapper valve device for full flush operations and to control the vent for a partial flushing operation.

U.S. Pat. No. 4,175,296 teaches a toilet flush tank having an attachment including an air passage for venting the air chamber and a water level responsive valve normally closing the air passage when the water within the tank is above a predetermined height and for venting the air chamber when the water within the tank is a predetermined height.

U.S. Pat. No. 4,225,987 shows a tank flush mechanism in which the trapped air in the flush discharge valve is vented to terminate the flush when the water level in the tank drops to a predetermined level. To provide a large volume flush, the flush handle is manipulated thereby allowing the flushing action to continue.

U.S. Pat. No. 4,593,419 discloses a buoyancy control unit for the flapper-type ball valve of a water closet flushing unit including a flexible air release metering tube connected to the outer peripheral portion of the flapper valve ball and extended upwardly from the stored water level. An adjustable meter valve is secured about the tube to adjustably collapse the tube for metering flow of air. A simple strap hanger has an offset apertured support tab through which the tube passes and on which the meter valve rests. The opposite strap end is bent and hooked over the edge of the tank.

U.S. Pat. No. 4,115,880 shows a control system for a toilet valve including an automatically controlled vent valve for controlling the venting of the flush valve to provide a long flush or a short flush controlled by a combination of the toilet flush handle and a float controlled latch within the tank.

Many of these prior art devices disclose various fittings for connecting the air conduit to the flapper. Unfortunately these air conduits represent one of the most trouble prone elements including entanglement with other structures in the tank, blockage due to the presence of water droplets, interference with the travel and function of the flapper valve, and limited life span due to physical wear and chemical degradation. Conduits of sufficient wall thickness to provide adequate life spans tend to be more rigid and thus may interfere with the proper function of the flapper. Conduits of thinner wall thickness are typically less rigid but are more susceptible to kinking and entanglement resulting from water currents present in the tank during the flush cycle. Reduced wall thickness also tends to reduce resistance to physical wear and chemical degradation. Therefore if a device is to function properly, the design of the air conduit should strike a balance between wall thickness and flexibility.

The prior art typically describes a slender, flexible tube with little slack between the control structure and the flapper. In nearly every example this tube takes the shape of a two-dimensional, shallow, "S" curve terminating perpendicularly to the plane of the flapper.

Such a configuration would appear to be desirable as the substantially vertical orientation encourages the drainage of water droplets. Further, by limiting the amount of slack between the control structure and the flapper, the tube is likely to be pulled into contact with other structures by water currents present in the tank.

When the flapper is drawn off the seat to initiate the flush cycle, the air conduit must bend to accommodate the axial movement of the flapper. It follows that the shorter the length of hose over which this bending may occur, the greater the resistance to said bending will be for a given material and wall thickness. Because the solutions of the prior art keep conduit length to a minimum, it is likely they must rely on thin wall sections in order to provide the flexibility necessary to avoid interfering with the operation of the flapper.

Since the lower end of the conduit terminates in a generally perpendicular orientation to the plane of the flapper, the conduit remains relatively distant from the axis of rotation of the flapper. The distance between the conduit and the flapper's axis of rotation combine with compressive or tensile stress in the conduit to create a moment about the axis of rotation which may act in opposition to the movement of the flapper about said axis.

Because the conduit attaches perpendicularly to the flapper, bending stresses in the conduit will have a greater tendency to create moment at the fitting. The effect of such moment is to pry the fitting off or through the surface of the flapper. Compensating for these problems by the use of an extremely flexible conduit generally produces unacceptable results. The lack of rigidity in such a conduit results in little or no resistance to lateral forces applied to the conduit by water currents. Because of this, the conduit is more susceptible to kinking and entanglement with other structures in the tank during the flush cycle.

SUMMARY OF THE INVENTION

The present invention relates to a flush valve control apparatus for use with a water closet to selectively permit a full or partial flush of water from the water storage tank.

In conventional fashion as water is fed to the water storage supply tank, a float member controls the water level within the water storage tank. A buoyant flapper valve having an air chamber formed therein is disposed to normally seal a flush outlet to selectively control the flow of water from the water storage tank.

The flush valve control apparatus comprises a first control valve disposed within the water storage tank and a second control valve disposed outside the water storage tank. The first control valve is connected to the second control valve by a first air conduit; while the second control valve is connected to the air chamber by a second air conduit.

The first valve control comprises a first valve actuator and first valve control housing. The first valve control actuator comprises a float actuator and first valve seal member; while, the first valve housing comprises a lower chamber and an upper air flow chamber to selectively control the flow of air through the upper air flow chamber. The upper air flow chamber comprises a first air passage open to the atmosphere and a second air passage coupled to the second control valve through the first air conduit.

The second control valve comprises a second valve actuator and second valve housing. The second valve actuator comprises a manual actuator and second valve seal member each movable between an open and closed position; while, the second valve housing comprises an upper chamber and a lower air flow chamber to selectively control the flow of air between the first air conduit and the second air conduit. The lower air flow chamber comprises a first air passage coupled to the air chamber through the second air conduit and a second air passage coupled to the first valve control through the first air conduit.

To install, the first valve control is mounted on an overflow pipe disposed within the water tank and the second valve control is mounted to the exterior of the water tank.

In use, the buoyant flapper valve is moved from sealing relationship with the flush outlet by a flush handle permitting water to flow from the water tank. Simultaneously, air within the air chamber flows through the second air conduit, second control valve, first air conduit and first control valve to the atmosphere to prematurely evacuate the air chamber causing the buoyant flapper valve to return to sealing relationship with the flush outlet. The result is a partial flush of a reduced volume of water. To operate in the full flush mode, the flush handle is actuated with the manual activator in the closed position such that the second valve seal member seals the lower air flow chamber trapping the air in the air chamber to prevent premature flow of the air therefrom resulting in a full flush.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE PREFERRED EMBODIMENT

Figure 1:
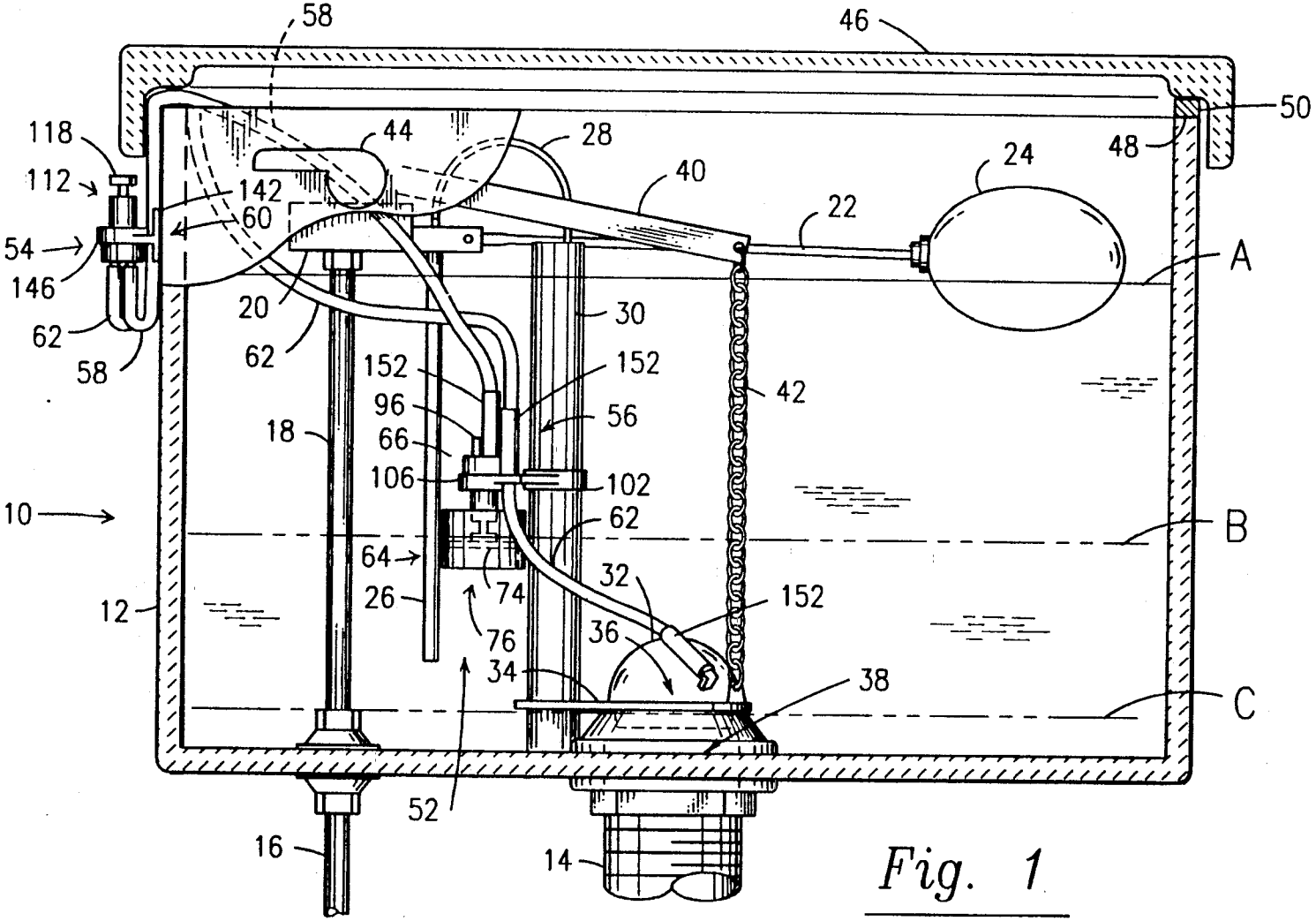
FIG. 1 is a cross-sectional front view of a water closet incorporating the flush valve control apparatus of the present invention.

As shown in FIG. 1, the present invention relates to a dual valve flush valve control apparatus for use with a water closet generally indicated as 10 to selectively permit a full or partial flush of water from the water storage tank 12.

As shown in FIG. 1, the water storage tank 12 is coupled to a toilet bowl (not shown) by a flush conduit 14. The water storage tank 12 is connected to a conventional water system (not shown) by an external water supply conduit 16. An internal water supply conduit 18, disposed within the water storage tank 12, is coupled between the external water supply conduit 16 and a water supply control valve 20 of conventional construction. The water supply control valve 20 is coupled to a pivotally mounted control arm 22 having a float member 24 secured to the outer end thereof. The float member 24 tends to drop under the force of gravity to open the water supply control valve 20 without the support of water within the water storage tank 12. In conventional fashion as water is fed to the water storage supply tank 12, the float member 24 rises moving the pivotally mounted control arm 22 upwardly. When the water within the water storage tank 12 reaches a predetermined level shown as A in FIG. 1, the water supply control valve 20 closes preventing additional water to flow to the water storage tank 12 from the conventional water supply (not shown). The water supply control valve 20 is connected to a first and second water delivery conduit indicated as 26 and 28 respectively. During the fill cycle, water is fed directly to the water storage tank 12 through the first water delivery conduit 26 and to the second water delivery conduit 28 through an overflow tube 30.

As shown in FIG. 1, a buoyant flapper valve 32, coupled to the lower portion of the overflow tube 30 by a flexible interconnecting member 34 and having an air chamber 36 formed therein, is disposed to normally seal a flush outlet 38 to selectively control the flow of water from the water storage tank 12 to the flush conduit 14. The buoyant flapper valve 32 is interconnected to one end of a pivotally mounted flush arm 40 by a flexible interconnecting element 42; while, the opposite end of the pivotally mounted flush arm 40 is coupled to a flush handle 44 as in a conventional system. A tank cover or top 46 may be held in spaced relationship relative to the top 48 of the water storage tank 12 by a spacer 50.

Figures 2, 3:
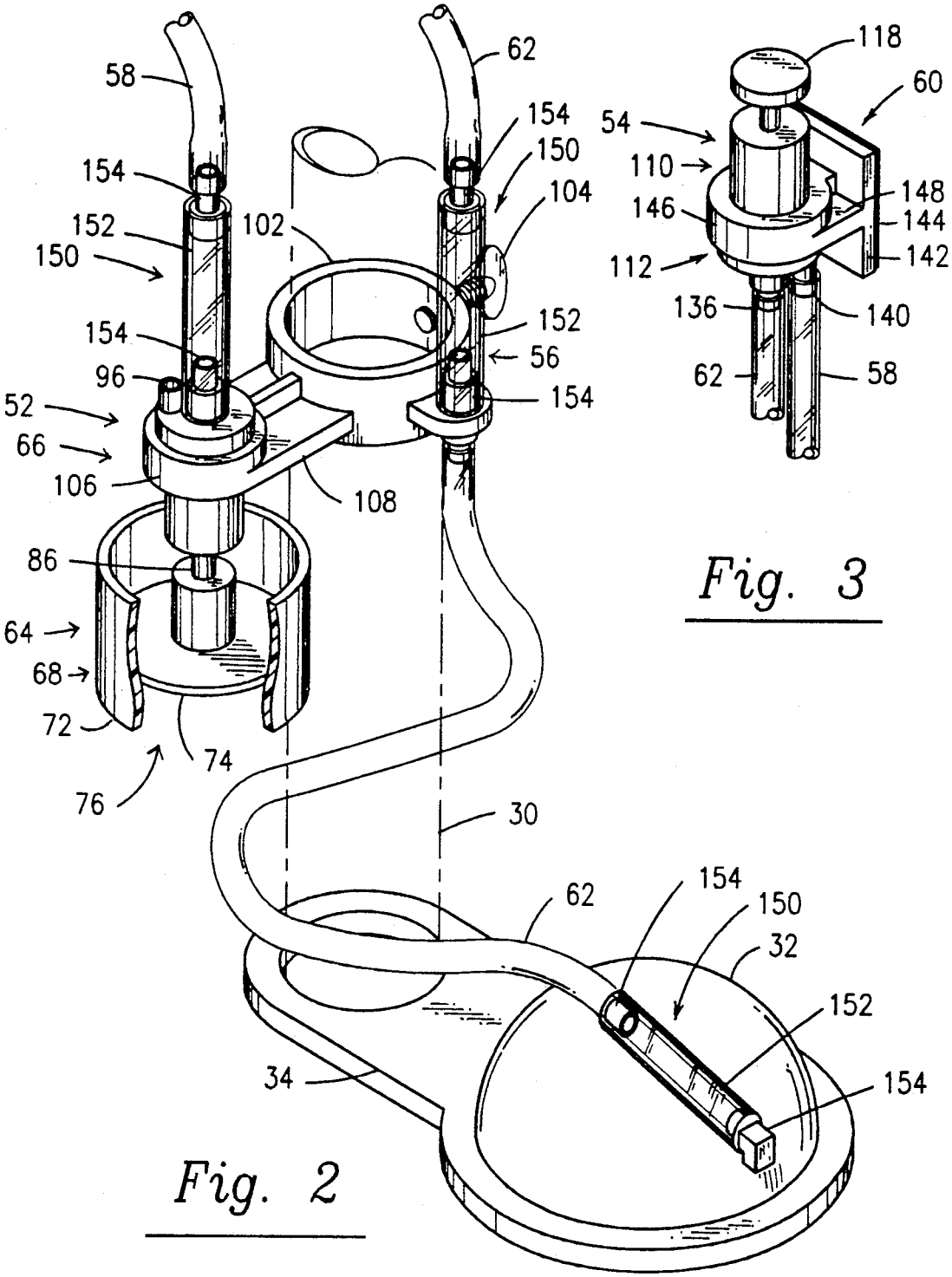
FIG. 2 is a perspective view of the first control valve of the present invention.
FIG. 3 is a perspective view of the second control valve of the present invention.

As shown in FIGS. 1 through 3, the flush valve control apparatus comprises a first control valve generally indicated as 52 disposed within the water storage tank 12 and a second control valve generally indicated as 54 disposed outside the water storage tank 12. The first control valve 52, coupled to the overflow tube 30 by a first mounting means generally indicated as 56, is connected to the second control valve 54 by a first air conduit 58. The second control valve 54, mounted to the side wall of the water storage tank 12 by a second mounting means generally indicated as 60, is connected to the air chamber 36 by a second air conduit 62.

Figure 5:
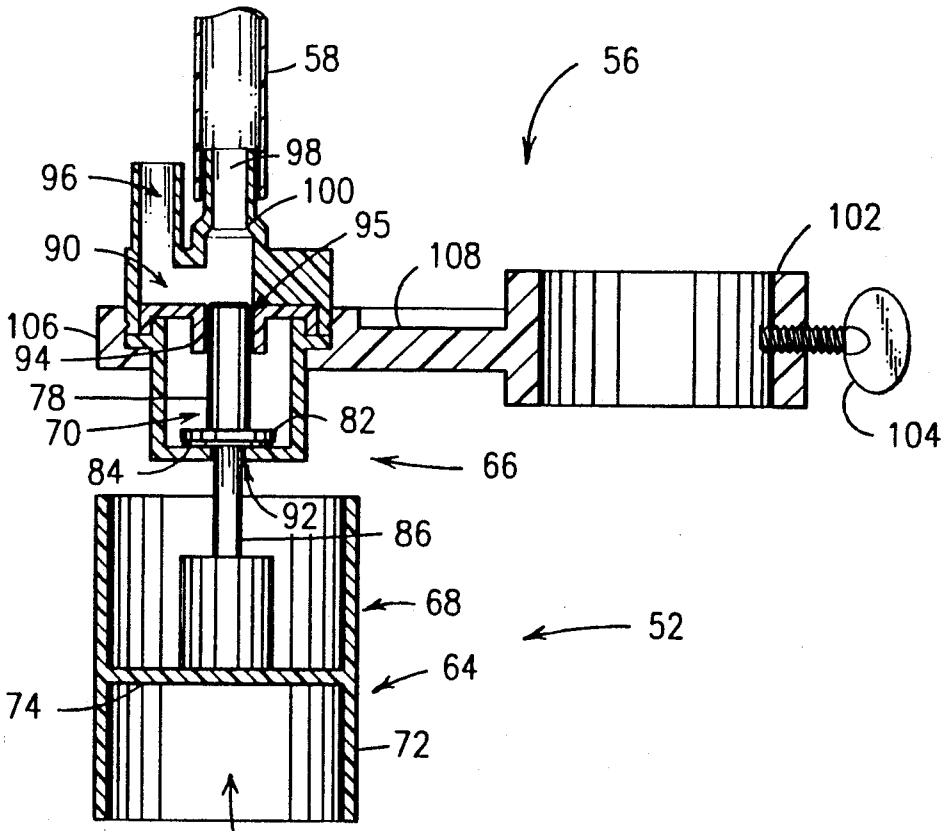
FIG. 5 is a detailed cross-sectional side view of the first control valve in the second or open position.
Figure 4:
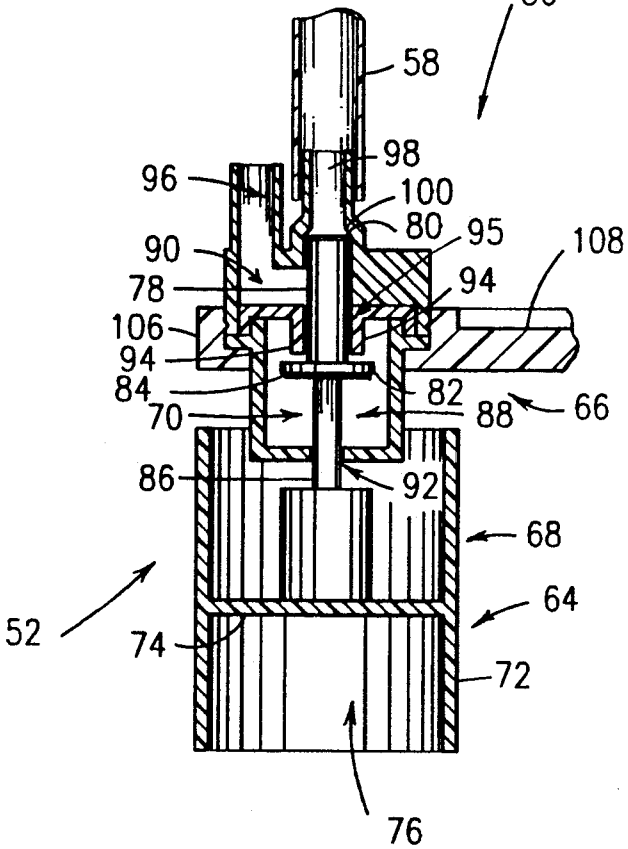
FIG. 4 is a detailed cross-sectional side view of the first control valve in the first or closed position.

As best shown in FIGS. 2, 4 and 5, the first control valve 52 comprises a first valve actuator and first valve housing generally indicated as 64 and 66 respectively. The first valve actuator 64 comprises a first control float and first valve seal member generally indicated as 68 and 70 respectively. The first control float 68 comprises a substantially cylindrical hollow float member 72 having a float diaphram 74 disposed therein to cooperatively form a float chamber 76. As shown in FIGS. 4 and 5, the first valve seal member 70 comprises an upper sealing member 78 having a beveled surface or edge 80 formed on the upper end thereof, an intermediate limit member 82 to limit the downward travel thereof as shown in FIG. 5 having an intermediate seal 84 formed on the lower surface thereof and a lower interconnecting member 86 coupled to the float diaphram 74 of the first control float 68. The first valve housing 66 comprises a lower chamber 88 to operatively house the intermediate limit member 82 and an upper air flow chamber 90 to selectively control the flow of air through the upper air flow chamber 90 as described more fully hereinafter. The lower chamber 88 includes a lower aperture 92 formed on the lower portion thereof to receive a portion of the interconnecting member 86 therethrough and a first directional guide 94 including an upper aperture 95 formed on the upper portion thereof to receive a portion of the upper sealing member 78 therethrough. The upper air flow chamber 90 comprises a first air passage 96 open to the atmosphere and a second air passage 98 coupled to the second control valve 54 through the first air conduit 58 including a first valve seat or beveled surface 100 to selectively receive the beveled surface or edge 80 of the upper sealing member 78 when the first valve seal member 70 is in the first or upper position as shown in FIG. 4.

As best shown in FIGS. 4 and 5, the first mounting means 56 comprises an annular mounting ring 102 secured to the overflow tube 30 by a bolt or thumbscrew 104 and a first valve housing support 106 to support the first control valve 52 interconnected to the annular mounting ring 102 by an interconnecting member 108.

Figure 7:
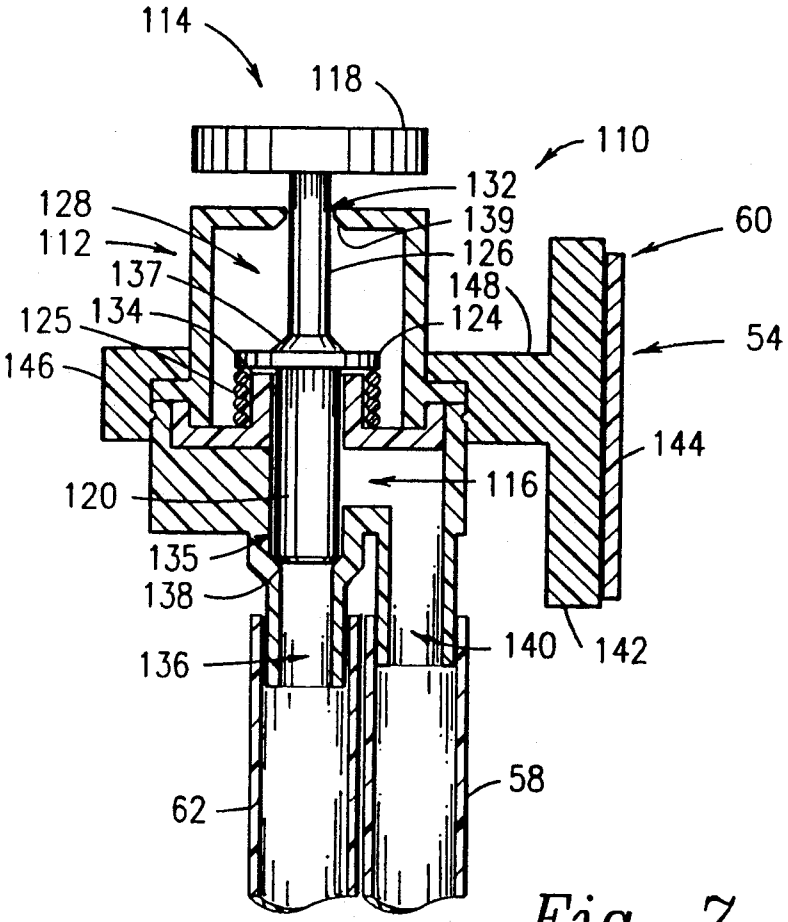
FIG. 7 is a detailed cross-sectional side view of the second control valve in the second or closed position.
Figure 6:
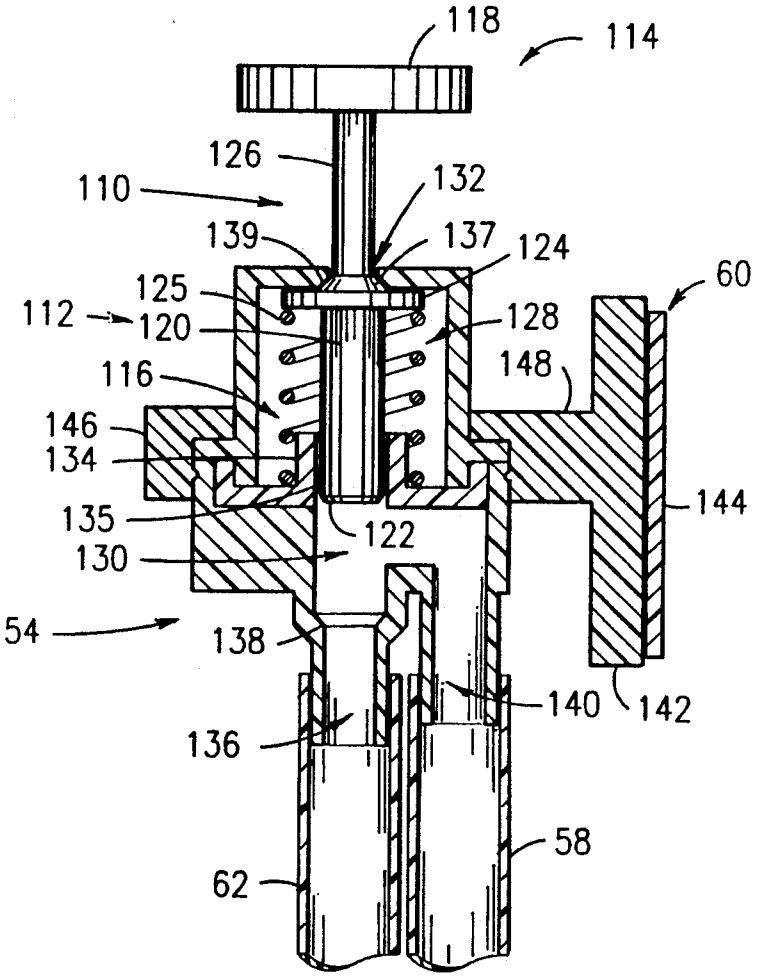
FIG. 6 is a detailed cross-sectional side view of the second control valve in the first or open position.

As best shown in FIGS. 3, 6 and 7, the second control valve 54 comprises a second valve actuator and second valve housing generally indicated as 110 and 112 respectively. The second valve actuator 110 comprises a manual actuator and second valve seal member generally indicated as 114 and 116 respectively. The manual actuator 114 comprises an hand actuator member 118. As shown in FIGS. 6 and 7, the second valve seal member 116 comprises a lower sealing member 120 having a beveled surface or edge 122 formed on the lower end thereof, an intermediate limit member 124 to limit the upward travel thereof under the influence of a bias or spring 125 as shown in FIG. 6 and an upper interconnecting member 126 coupled to hand actuator member 118 of the manual actuator 114. The second valve housing 112 comprises an upper chamber 128 to house the intermediate limit member 124 and a lower air flow chamber 130 to selectively control the flow of air between the first air conduit 58 and the second air conduit 62 as described more fully hereinafter. The upper chamber 128 includes an upper aperture 132 formed on the upper portion thereof to receive a portion of the interconnecting member 126 therethrough and a directional guide 134 including a lower aperture 135 formed on the lower portion thereof to receive a portion of the lower sealing member 120 therethrough. A seal or beveled surface 137 is formed on the upper surface of the intermediate limit member 124 to engage a beveled recess 139 formed on the upper aperture 132 to selectively seal the upper aperture 132 as shown in FIG. 6. The lower air flow chamber 130 comprises a first air passage 136 coupled to the air chamber 36 through the second air conduit 62 including a second valve seat or beveled surface 138 to selectively receive the beveled surface or edge 122 of the sealing member 120 when in the lower position as shown in FIG. 7 and a second air passage 140 coupled to the first valve control 52 through the first air conduit 58.

As best shown in FIGS. 6 and 7, the second mounting means 60 comprises a substantially flat mounting member 142 secured to the side of the water storage tank 12 by a pressure sensitive adhesive element 144, a second valve housing support 146 to operatively support the second control valve 54 interconnected to the substantially flat mounting member 142 by an interconnecting member 148.

As best shown in FIG. 2, the flush valve control apparatus 10 further includes a plurality of vacuum breakers each generally indicated as 150 to prevent air lock within either the first or second air conduit 58 and 62. Specifically, each vacuum breaker 150 comprises a hollow breaker body 152 having a diameter greater than the diameter of either the first or second air conduit 58 or 62 sufficiently large to prevent water droplets from blocking air flow therethrough. Ends of the hollow breaker body 150 are coupled to the first and second air conduits 58 and 62 and buoyant flapper valve 32 by transition members each indicated as 154. The lower portion of the second air conduit 62 may comprise a thin wall flexible tubing to reduce interference with the operation of the buoyant flapper valve 32.

Figure 9:
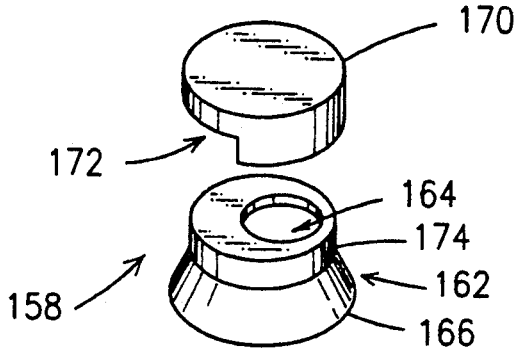
FIG. 9 is an exploded view of the cap of the buoyant flapper valve shown in FIG. 8.
Figure 8:
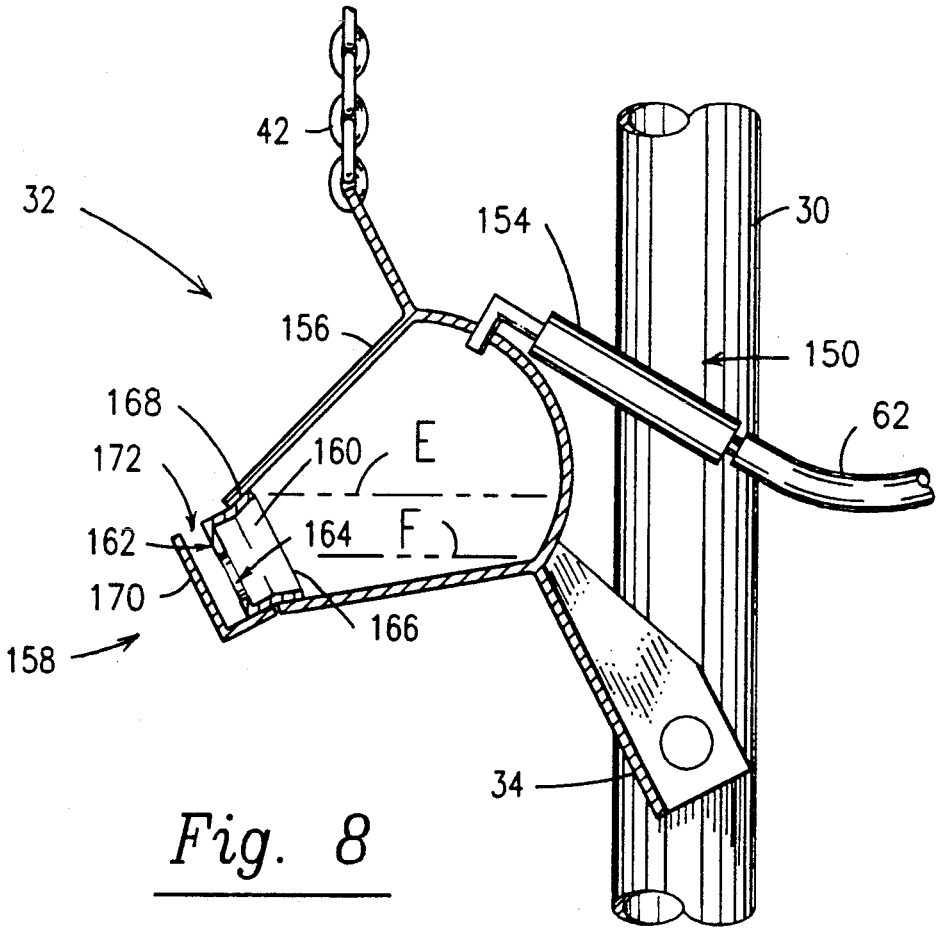
FIG. 8 is a detailed cross-sectional side view of an alternate embodiment of the buoyant flapper valve.

FIGS. 8 and 9 show an alternate embodiment of the buoyant flapper valve 32. Specifically, the buoyant flapper valve 32 comprises a hollow body 156 having a cap generally indicated as 158 mounted to the open end 160 thereof. The cap 158 comprises an inner cap member generally indicated as 162 including an offset flow aperture 164 formed on the lower portion thereof mounted to the open end 160 by an inclined skirt 166 attached to the inside wall 168 of the hollow body 156 and an outer cap member 170 including a flow slot 172 formed on the upper portion thereof attached to the outer wall 174 of the inner cap member 162. The alternate buoyant flapper valve 32 reduces amount of air that escapes through bottom thereof when in open position. Thus, when a full flush is desired an increased amount of water is released since buoyant flapper valve 32 is more buoyant. The outer cap member 170 deflects any air bubbles that could enter buoyant flapper valve 32 from beneath that would otherwise frustrate the partial flush function. As shown, the water level with the buoyant flapper valve 32 would be at E without the outer cap member 170 and at F with the outer cap member 170.

To install the flexible interconnecting member 34 of the buoyant flapper valve 32 and annular mounting ring 102 of the first control valve 52 are operatively mounted on the overflow tube 30; while the substantially flat mounting member 142 of the second control valve 54 is secured to the side of the water storage tank 12.

As shown in FIG. 1, when the water storage tank 12 is full, the water level A will support the float member 24 causing the buoyant flapper valve 32 to seal the flush outlet 38. In use, the buoyant flapper valve 32 is moved to the open position by actuating the flush handle 44. As water flows from the water storage tank 12 through the flush outlet 38, the first control float 68 moves from the first position (FIG. 4) to the second position (FIG. 5) permitting air to flow from the air chamber 36 through the first and second control valves 52 and 54 to the interior of the water storage tank 12 to permaturely evacuate the air chamber 36 causing the buoyant flapper valve 32 to return to sealing relationship with the flush outlet 38 resulting in a partial flush of a reduced volume of water shown as B in FIG. 1. To operate in the full flush mode, the flush handle 44 is moved from the first to second position while the second valve actuator 110 is moved from the first position (FIG. 6) to the second position (FIG. 7). In this configuration, the lower sealing member 120 prevents air from flowing to the first control valve 52 and the interior of the water storage tank 12 temporarily trapping a portion of the air in the air chamber 36 to prevent premature flow of the air therefrom resulting in a full flush of water shown as C in FIG. 1.

Figure 10:
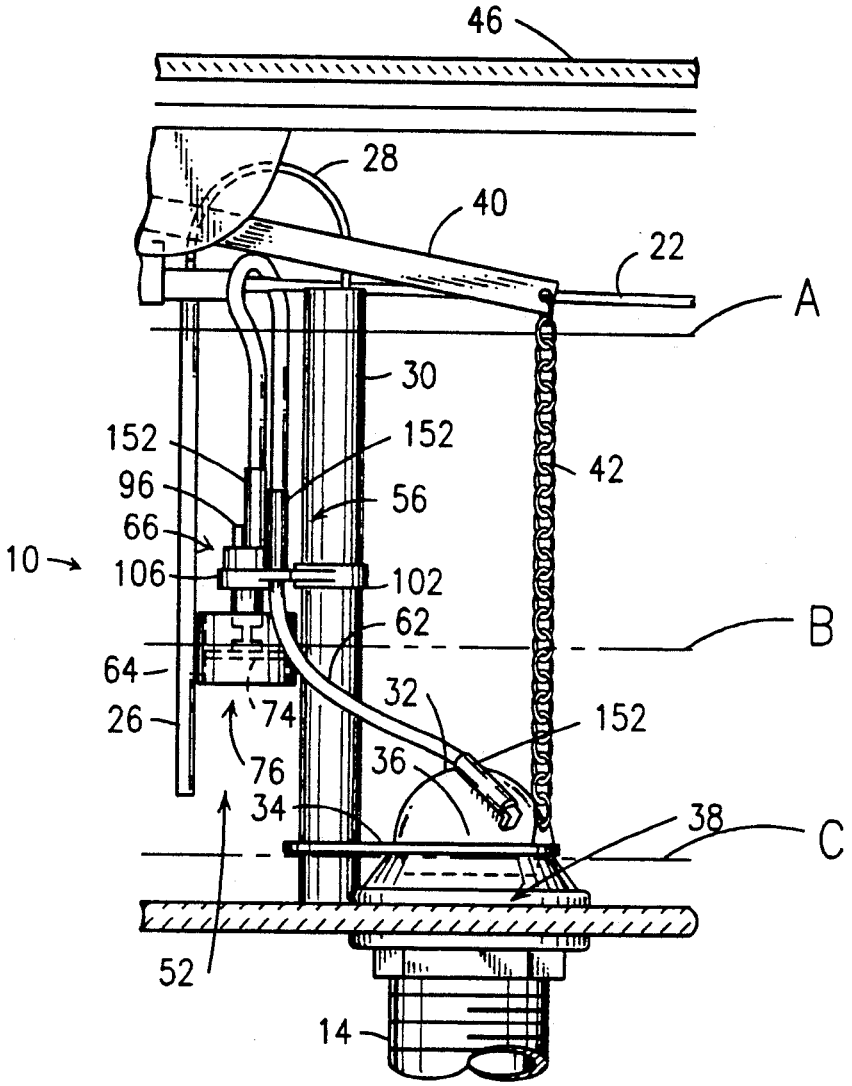
FIG. 10 is a cross-sectional front view of a water closet incorporating an alternate embodiment of the flush valve control apparatus of the present invention.

FIG. 10 shows an alternate embodiment of a single valve flush valve control apparatus comprising a first control valve generally indicated as 52 disposed within the water storage tank 12 coupled to the overflow tube 30 by a first mounting means generally indicated as 56. The first control valve 52 comprises a first valve actuator and first valve housing generally indicated as 64 and 66 respectively. The first valve actuator 64 and a first valve housing 66 are similarly constructed to those depicted in FIGS. 2, 4 and 5. However, the air chamber 36 is coupled to the upper air flow chamber 90, as best shown in FIGS. 4 and 5, through the air conduit 62 rather than the air conduit 58, and second air passage 98 thence through the first air passage 96 to the atmosphere.

The partial flush mode is accomplished substantially the same as in the first embodiment. To operate in the full flush mode, the flush handle 44 is held in the second position until the water tank 12 is evacuated.

Figure 11:
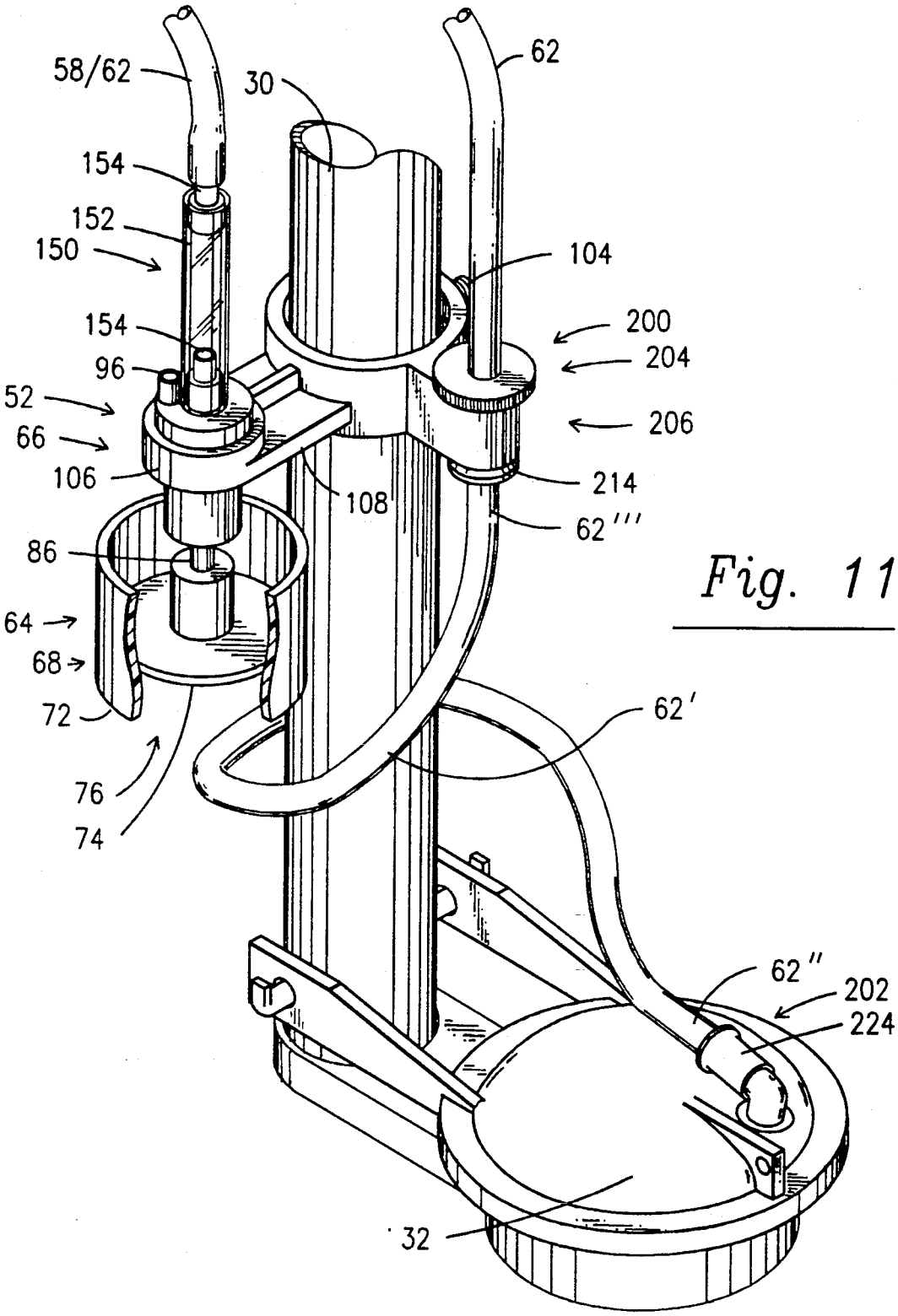
FIG. 11 is a perspective view of the first control valve of the present invention with an adjustable air conduit means.

FIGS. 11 through 14 show an air conduit control means for use with either the single or dual valve embodiment previously described. The air conduit control means permits the air conduit 62 to have a greater wall thickness than previously used to increase resistance to physical wear and chemical degradation. As best shown in FIG. 11, the lower portion 62' of the air conduit 62 is disposed or arranged in a conic helix configuration, preferably around the overflow tube 30, between an air conduit adjustment member generally indicated as 200 and the buoyant flapper valve 32. Because the lower portion 62' of the air conduit passes through the axis of rotation and is connected to the buoyant flapper valve 32 parallel to the plane of the buoyant flapper valve 32, compressive and tensile forces in the air conduit 62 create little or no moment about the axis. Additionally, when properly adjusted, the conic helix configuration limits the bending stress in the lower end 62'' of the lower portion connected to the buoyant flapper valve 32 by an air conduit/flapper connector means generally indicated as 202.

The use of larger conduits of course allows larger inner diameters. This is important since the larger the inner diameter of the conduit, the less chance there is that the air conduit 62 will be blocked by water droplets.

In practice, the downward spiral of the air conduit 62 includes a sufficient vertical component to facilitate the drainage of the water which enters the lower end 62'' of the air conduit 62 during the flush cycle.

While the conic helix configuration provides relatively little resistance to forces applied substantially parallel to its longitudinal axis, the curvature of the air conduit 62 renders the air conduit 62 relatively rigid in the horizontal plane. This horizontal rigidity makes the air conduit 62 less susceptible to the influence of water currents in the water storage tank 12 during the flush cycle. Because of this, it is much easier to avoid entanglement or excessive wear which may result if the conduit comes in contact with other structures in the tank.

Figure 12:
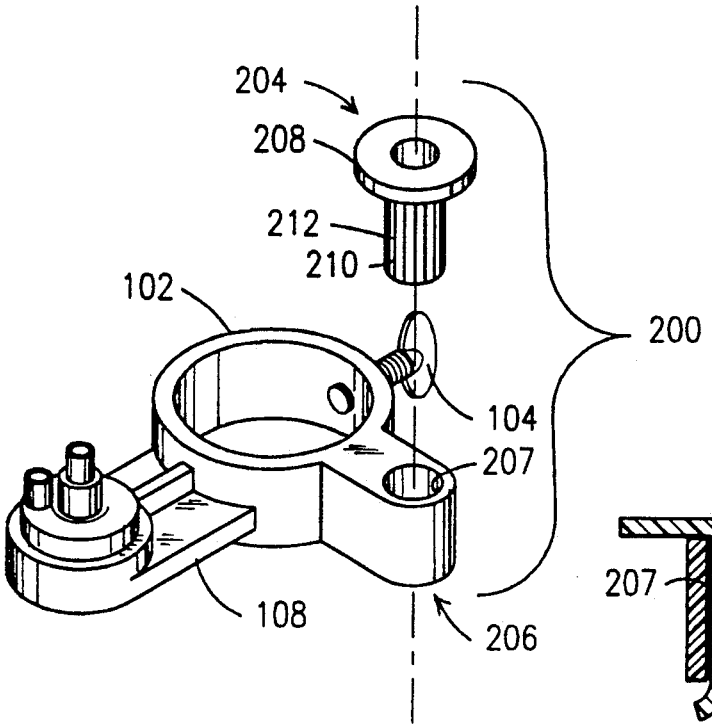
FIG. 12 is a perspective view of the air conduit control means and annular mounting ring.
Figure 13:
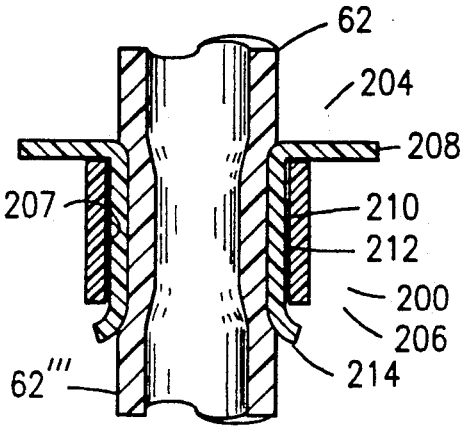
FIG. 13 is a cross-sectional side view of the air conduit control means.

As best shown in FIGS. 12 and 13, the air conduit adjustment member 200 comprises an adjustable element generally indicated as 204 operatively mounted to a mounting means generally indicated as 206 affixed to the annular mounting ring 102 having a channel 207 formed therethrough to receive a portion of the adjustable element 204 therein. As best shown in FIGS. 12 and 13, the adjustable element 204 comprises an upper substantially horizontal annular adjustment element 208, an intermediate substantially vertical cylindrical hollow sleeve 210 having a plurality of teeth or ridges each indicated as 212 formed on the outer surface thereof and a lower arcuate or curved skirt or flange 214. After adjustment element 204 is placed in the channel 207, the lower arcuate or curved flange or skirt 214 is heat rolled outwardly to form or prevent removal of the adjustable element 204. The air conduit 62 is fed through the intermediate substantially vertical cylindrical hollow sleeve 210 having an inner diameter less than the non-compressed air conduit 62. Thus during normal operation, upper end 62'' of the lower portion 62' of the air conduit 62 will not move longitudinally or axially within the intermediate substantially vertical cylindrical hollow sleeve 210.

Longitudinal adjustment is easily accomplished by grasping the air conduit 62 between the fingers and pushing or pulling into the desired configuration. Axial adjustment is accomplished by rotation of the adjustable instant element 204.

The inner surface of the channel 207 and the teeth or ridges 212 engage each other to interact to a graduated rotation and to prevent inadvertant axial movement once adjusted. The rotation will produce a noticeable "click".

Figure 14:
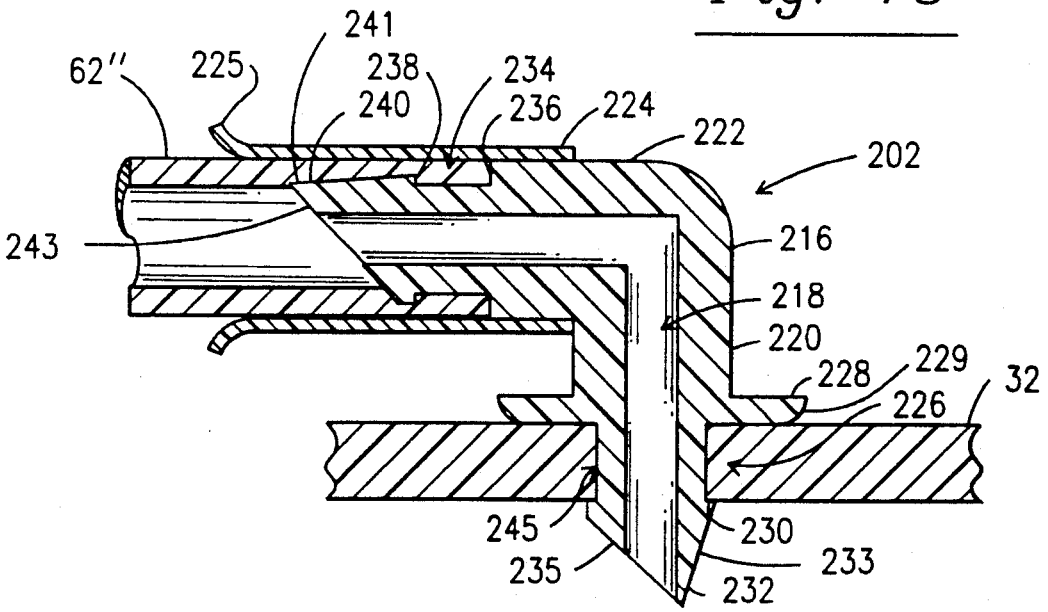
FIG. 14 is a cross-sectional side view of the air conduit/flapper connection means.

As best shown in FIG. 14, the air conduit/flapper connection means 202 comprises a conduit connector 216 having an air passage 218 formed therethrough including a first and second leg indicated as 220 and 222 respectively. A substantially horizontal cylindrical hollow connector sleeve 224 having an arcuate skirt or flange 225 formed thereon engages the outer surface of the lower end 62'' of the air conduit 62 and the second leg 222. A first recess 226 is cooperatively formed between a flange 228 having a convex surface 229 and a shoulder 230 formed on a first connector tip 232 which includes an inclined side wall 233 and an inclined end wall 235. A second recess 234 is cooperatively formed between a first shoulder 236 and a second shoulder 238 of a second connector tip 240 which includes an inclined side wall 241 and an inclined end wall 243.

The air conduit 62 slides over the second connector tip 240. In turn, the sleeve 224 slides over the air conduit 62 and outer surface of the second leg 222. The wall of the air conduit 62 is compressed or pinched between inner surface of the sleeve 224 and the second recess 234. The inclined end wall 243 and inclined side wall 241 facilitate the placement. In addition, the inclined end wall 235 and inclined side wall 233 facilitate the first connector tip 232 through a small aperture 245 formed in the buoyant flapper valve 32.

The combination of the fitting and sleeve produce a form which is easy to grip when inserting the fitting in the wall of the flapper.

The substantially horizontal cylindrical hollow connector sleeve 224 tends to shield the air conduit 62 from water and air at the point of greatest stress. Because stress tends to accelerate the chemical degradation of the latex and similar materials, shielding this area from contact with chlorine, should extend the useful life of the conduit.

The arcuate skirt or flange 225 is designed to reduce wear on the air conduit 62 at that point caused by bending stress.

The flange 228 spreads bending and compressive/tensile stresses out over a greater area of the buoyant flapper valve 32 in order to increase the overall strength of the connection. The convex surface 229 of the flange 228 is rolled to reduce wear as due to movement of the fitting and stresses caused by bending of the air conduit 62 or buoyant flapper valve 32.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all 33, statements of the scope of the invention which, as a matter of language, might be said to fan therebetween.

Now that the invention has been described,

What is claimed is:

1. A flush valve control apparatus selectively operable in a partial flush mode and full flush mode for use with a water closet including a flush outlet formed in the lower portion thereof and a buoyant flapper valve having an air chamber formed therein and open on the lower surface thereof movable between a closed position and open position by a flush handle movable between a first and second position to initiate a flush cycle to selectively control the flow of water through the flush outlet, said flush valve control apparatus comprises a first and second control valve, said first control valve is operatively coupled to said second control valve by an air conduit and includes a first valve actuator movable between a first position and a second position and a first valve housing including a first air passage open to the atmosphere and a second air passage coupled to said second control valve through said air conduit, said second control valve is operatively coupled to the buoyant flapper valve by an air conduit includes a second valve actuator movable between a first position and a second position and a second valve housing including a first air passage coupled to the air chamber formed in the buoyant flapper valve by an air conduit and a second air passage coupled to said second air passage of said first control valve by said air conduit coupled between said first and second control valves to selectively control the flow of air from the air chamber through said first and second control valves to the atmosphere to control the movement of the buoyant flapper valve during the flush cycle such that when the flush handle is moved form the first to second position the buoyant flapper valve is moved from the closed position to the open position allowing water to flow from the water closet through the flush outlet and when said first valve actuator is in said second position and said second valve actuator is in said first position air flows from the air chamber through said first and second control valves to the atmosphere to operate in the partial flush mode discharging a first volume of water; and when the flush handle is moved from the first to second position the buoyant flapper valve is moved from the closed position to the open position allowing water to flow from the water closet through the flush outlet and when said first and second valve actuators are each in said second position said second valve actuator isolates the air chamber of the buoyant flapper valve from said first valve actuator and the atmosphere to operate in the full flush mode discharging a second volume of water.

2. The flush valve control apparatus of claim 1 wherein said first control valve comprises a first valve actuator and first valve housing and said second control valve comprising a second valve actuator and second valve housing.

3. The flush valve control apparatus of claim 2 wherein said first valve actuator comprises a first control float and first valve seal member and said second valve actuator comprises a manual actuator and second valve seal member.

4. The flush valve control apparatus of claim 3 wherein said first control float comprises a substantially cylindrical hollow float member having a float diaphram disposed therein to cooperatively form a float chamber.

5. The flush valve control apparatus of claim 4 wherein said first valve seal member comprises an upper sealing member and a lower interconnecting member coupled to said float diaphram of the first control float.

6. The flush valve control apparatus of claim 5 wherein said upper sealing member includes a beveled surface formed on the upper end thereof.

7. The flush valve control apparatus of claim 5 wherein said first valve seal member further includes an intermediate limit member to limit the downward travel thereof having an intermediate seal formed on the lower surface thereof.

8. The flush valve control apparatus of claim 6 wherein said first valve housing comprises a lower chamber to operatively house said intermediate limit member and an upper air flow chamber to selectively control the flow of air through said upper air flow chamber and wherein said second valve housing comprises an upper chamber to house said intermediate limit member and a lower air flow chamber to selectively control the flow of air between a first air conduit coupled between said first and second control valves and a second air conduit coupled between said air chamber and said second control valve.

9. The flush valve control apparatus of claim 8 wherein said lower chamber includes a lower aperture formed on the lower portion thereof to receive a portion of said interconnecting member therethrough and a first directional guide including an upper aperture formed on the upper portion thereof to receive a portion of said upper sealing member therethrough and said upper chamber including an upper aperture formed on the upper portion thereof to receive a portion of said interconnecting member therethrough and said directional guide including a lower aperture formed on the lower portion thereof to receive a portion of said lower sealing member therethrough.

10. The flush valve control apparatus of claim 9 wherein said upper air flow chamber comprises a first air passage open to the atmosphere and a second air passage coupled to said second control valve through said first air conduit and said lower air flow chamber comprises a first air passage coupled to said air chamber through said second air conduit.

11. The flush valve control apparatus of claim 10 including a first valve seat or beveled surface to selectively receive said beveled surface of said upper sealing member when said first valve seal member in said first position and further including a second valve seat to selectively receive said beveled surface of said sealing member when in said lower position and a second air passage coupled to said first valve control through said first air conduit.

12. The flush valve control apparatus of claim 11 including a beveled surface formed on the upper surface of said intermediate limit member to engage a beveled recess formed on said upper aperture to selectively seal said upper aperture.

13. A flush valve control apparatus selectively operable in a partial flush mode and full flush mode for use with a water closet including a flush outlet formed in the lower portion thereof and a buoyant flapper valve having an air chamber formed therein and open at the lower surface thereof movable between a closed position and open position by a flush handle movable between a first and second position to initiate a flush cycle to selectively control the flow of water through the flush outlet, said flush valve control apparatus comprises a first and second control valve, said first control valve is operatively coupled to said second control valve by an air conduit and includes a second position, said first valve actuator comprises a first control float including a substantially cylindrical hollow float member having a float diaphram disposed therein to cooperatively form a float chamber and a first valve housing including an upper sealing member, an intermediate limit member to limit the downward travel thereof having an intermediate seal formed on the lower surface thereof and a lower interconnecting member coupled to said float diaphram of the first control float including a first air passage open to the atmosphere and a second air passage coupled to said second control valve through said air conduit, said second control valve is operatively coupled to the buoyant flapper valve by an air conduit and includes a second valve actuator movable between a first position and a second position comprising a manual actuator and second valve seal member and a second valve housing including a first air passage coupled to the air chamber formed in the buoyant flapper valve by an air conduit and a second air passage coupled to said second air passage of said first control valve by said air conduit coupled between said first and second control valves to selectively control the flow of air from the air chamber through said first and second control valves to the atmosphere to control the movement of the buoyant flapper valve during the flush cycle such that when the flush handle is moved from the first to second position the buoyant flapper valve is moved from the closed position to the open position allowing water to flow from the water closet through the flush outlet and when said first valve actuator is in said second position and said second valve actuator is in said first position air flows from the air chamber through said first and second control valves to the atmosphere to operate in the partial flush mode discharging a first volume of water; and when the flush handle is moved from the first to second position the buoyant flapper valve is moved from the closed position to the open position allowing water to flow from the water closet through the flush outlet and when said first and second valve actuators are each in said second position said second valve actuator isolates the air chamber of the buoyant flapper valve from said first valve actuator and the atmosphere to operate in the full flush mode discharging a second volume of water and when said flush handle is moved from the first to second position the buoyant flapper valve is moved to the open position allowing water to flow from the water closet through the flush outlet and when said first valve actuator is in said second position and said second valve actuator is in said first position air flows from the air chamber through said first and second control valves to operate in the partial flush mode discharging a first volume of water or when the flush handle is moved from the first to second position the buoyant flapper valve is moved to the open position allowing water to flow from the water closet through the flush outlet and when said first and second valve actuators are each in said second position said second valve actuator isolates the air chamber of the buoyant flapper valve from said first valve actuator and the atmosphere the full flush mode discharging a second volume of water.

14. The flush valve control apparatus of claim 13 wherein said upper sealing member includes a beveled surface formed on the upper end thereof.

15. The flush valve control apparatus of claim 14 wherein said first valve housing comprises a lower chamber to operatively house said intermediate limit member and an upper air flow chamber to selectively control the flow of air through said upper air flow chamber and wherein said second valve housing comprises an upper chamber to house said intermediate limit member and a lower air flow chamber to selectively control the flow of air between a first air conduit coupled between said first and second control valves and a second air conduit coupled between said air chamber and said second control valve.

16. The flush valve control apparatus of claim 15 wherein said lower chamber includes a lower aperture formed on the lower portion thereof to receive a portion of said interconnecting member therethrough and a first directional guide including an upper aperture formed on the upper portion thereof to receive a portion of said upper sealing member therethrough and said upper chamber including an upper aperture formed on the upper portion thereof to receive a portion of said interconnecting member therethrough and said directional guide including a lower aperture formed on the lower portion thereof to receive a portion of said lower sealing member therethrough.

17. The flush valve control apparatus of claim 16 wherein said upper air flow chamber comprises a first air passage open to the atmosphere and a second air passage coupled to said second control valve through said first air conduit and said lower air flow chamber comprises a first air passage coupled to said air chamber through said second air conduit.

18. The flush valve control apparatus of claim 17 including a first valve seat or beveled surface to selectively receive said beveled surface of said upper sealing member when said first valve seal member in said first position and further including a second valve seat to selectively receive said beveled surface of said sealing member when in said lower position and a second air passage coupled to said first valve control through said first air conduit.

19. The flush valve control apparatus of claim 18 including a beveled surface formed on the upper surface of said intermediate limit member to engage a beveled recess formed on said upper aperture to selectively seal said upper aperture.

* * * * *